US010808565B2

(12) United States Patent
Walston et al.

(10) Patent No.: US 10,808,565 B2
(45) Date of Patent: Oct. 20, 2020

(54) TAPERED ABRADABLE COATINGS

(71) Applicants: Rolls-Royce Corporation, Indianapolis, IN (US); Rolls-Royce plc, London (GB)

(72) Inventors: Jeffrey Allen Walston, Indianapolis, IN (US); Roy Peter McIntyre, Derby (GB); Daniel Kent Vetters, Indianapolis, IN (US)

(73) Assignees: Rolls-Royce plc, London (GB); Rolls-Royce Corporation, Indianapolis, IN (US)

( * ) Notice: Subject to any disclaimer, the term of this patent is extended or adjusted under 35 U.S.C. 154(b) by 153 days.

(21) Appl. No.: 15/986,570

(22) Filed: May 22, 2018

(65) Prior Publication Data

US 2019/0360351 A1 Nov. 28, 2019

(51) Int. Cl.
*F01D 11/12* (2006.01)

(52) U.S. Cl.
CPC ..... *F01D 11/122* (2013.01); *F05D 2230/31* (2013.01); *F05D 2230/90* (2013.01); *F05D 2240/11* (2013.01)

(58) Field of Classification Search
CPC ..... F01D 11/122; F05D 2230/31; F05D 2230/90; F05D 2240/11
See application file for complete search history.

(56) References Cited

U.S. PATENT DOCUMENTS 3,519,282 A * 7/1970 Davis ..... C22C 47/14 277/414
3,719,365 A * 3/1973 Emmerson ..... F01D 11/12 277/414
4,218,066 A * 8/1980 Ackermann ..... F01D 11/02 277/414
4,269,903 A 5/1981 Clingman et al.
(Continued)

FOREIGN PATENT DOCUMENTS

EP 3239475 A1 11/2017
WO WO-2015173312 A1 * 11/2015 ..... F01D 11/122

OTHER PUBLICATIONS

Extended Search Report from counterpart European Application No. 19169441.3, dated Nov. 7, 2019, 6 pp.
(Continued)

*Primary Examiner* — Moshe Wilensky
*Assistant Examiner* — Brian Christopher Delrue
(74) *Attorney, Agent, or Firm* — Shumaker & Sieffert, P.A.

(57) ABSTRACT

In some examples, a system includes a blade including a blade tip and a blade track or blade shroud segment including a substrate and an abradable coating layer on the substrate. The substrate defines a leading edge and a trailing edge. The abradable coating layer includes a first tapered portion that substantially continuously tapers from a center portion of the substrate toward the leading edge of the substrate, a second tapered portion that substantially continuously tapers from the center portion of the substrate
(Continued)

toward the trailing edge of the substrate, and a blade rub portion that extends between the first tapered portion and the second tapered portion. The abradable coating extends from the leading edge to the trailing edge, and the blade tip is configured to contact at least a portion of the blade rub portion upon rotation of the blade.

14 Claims, 6 Drawing Sheets

(56) References Cited

U.S. PATENT DOCUMENTS 4,337,016 A * 6/1982 Chaplin ..... F01D 11/24 415/116
4,422,648 A * 12/1983 Eaton ..... F01D 11/12 277/415
4,503,130 A 3/1985 Bosshart et al.
4,639,388 A * 1/1987 Ainsworth ..... B32B 15/04 428/117
4,744,725 A * 5/1988 Matarese ..... C23C 4/18 415/173.4
5,167,721 A * 12/1992 McComas ..... B08B 3/02 134/32
5,375,973 A * 12/1994 Sloop ..... F01D 11/08 415/115
5,439,348 A * 8/1995 Hughes ..... F01D 11/122 29/889.2
5,662,757 A * 9/1997 Langenbrunner ..... F01D 11/12 156/298
5,683,789 A * 11/1997 Langenbrunner ..... F01D 11/12 252/511
6,203,021 B1 * 3/2001 Wolfla ..... C23C 4/18 277/415
6,358,002 B1 * 3/2002 Good ..... F01D 11/122 415/174.4
6,652,227 B2 * 11/2003 Fried ..... F01D 11/122 415/173.4
6,670,046 B1 * 12/2003 Xia ..... C23C 4/00 416/229 A
6,887,529 B2 * 5/2005 Borneman ..... C23C 4/02 118/503
7,819,625 B2 * 10/2010 Merrill ..... F01D 11/122 415/170.1
8,100,640 B2 * 1/2012 Strock ..... F01D 11/122 415/173.4
8,172,519 B2 5/2012 Jarrabet et al.
8,309,197 B2 * 11/2012 Davis ..... B32B 3/30 415/174.4
8,650,753 B2 * 2/2014 Sellars ..... F01D 11/122 277/303
8,658,255 B2 2/2014 Kirby et al.
8,939,707 B1 * 1/2015 Lee ..... F01D 11/122 415/1
9,458,726 B2 * 10/2016 Lamusga ..... F01D 11/08
9,598,973 B2 * 3/2017 Ghasripoor ..... F16J 15/445
9,644,489 B1 * 5/2017 Tham ..... B33Y 10/00
9,713,912 B2 7/2017 Lee
9,759,082 B2 9/2017 Thomas et al.
9,995,165 B2 * 6/2018 Joe ..... F01D 11/08
10,196,918 B2 2/2019 McCaffrey
10,247,027 B2 4/2019 Rioux et al.
10,267,174 B2 4/2019 Liu et al.
10,494,945 B2 * 12/2019 Grande ..... C23C 4/131
2003/0054196 A1 * 3/2003 Lau ..... C23C 4/02 428/655
2003/0138658 A1 * 7/2003 Taylor ..... C03C 17/3411 428/632
2005/0220612 A1 * 10/2005 Jahns ..... F01D 9/04 415/179
2007/0205189 A1 * 9/2007 Grossklaus, Jr. ..... B23K 26/34 219/617
2009/0110536 A1 * 4/2009 Strock ..... F01D 11/122 415/1
2009/0324930 A1 12/2009 Tulyani et al.
2010/0030365 A1 * 2/2010 Lilly ..... B23C 17/20 700/163
2010/0104426 A1 * 4/2010 Keller ..... F01D 11/12 415/173.1
2010/0129636 A1 * 5/2010 Cybulsky ..... C04B 41/009 428/310.5
2010/0136349 A1 * 6/2010 Lee ..... C04B 41/009 428/446
2010/0159151 A1 6/2010 Kirby et al.
2011/0033630 A1 * 2/2011 Naik ..... C04B 41/52 427/452
2011/0219775 A1 9/2011 Jarmon et al.
2013/0078085 A1 * 3/2013 Strock ..... F01D 11/122 415/173.4
2013/0236293 A1 * 9/2013 Adaickalasamy ..... F01D 9/04 415/139
2014/0199163 A1 * 7/2014 Lee ..... C23C 28/04 415/174.4
2014/0367921 A1 * 12/2014 Konigs ..... B29C 70/86 277/345
2015/0048553 A1 * 2/2015 Dietrich ..... B33Y 40/00 264/401
2015/0239010 A1 * 8/2015 Cheung ..... C23C 24/04 427/189
2015/0354395 A1 * 12/2015 Scothern ..... F01D 11/122 416/185
2016/0047264 A1 * 2/2016 Joe ..... F01D 11/08 415/116
2016/0146034 A1 * 5/2016 Schuster ..... F01D 11/125 415/173.4
2016/0305319 A1 * 10/2016 Baldiga ..... C04B 41/5096
2016/0369636 A1 * 12/2016 Hitchman ..... F01D 11/122
2017/0089213 A1 * 3/2017 Stevens ..... F01D 11/001
2017/0268367 A1 * 9/2017 McCaffrey ..... F16J 15/3464
2017/0276007 A1 * 9/2017 Rioux ..... F04D 29/164
2017/0306783 A1 * 10/2017 Grande ..... C23C 4/126
2017/0314410 A1 * 11/2017 Liu ..... C22C 19/058
2018/0023396 A1 * 1/2018 Narrow ..... F01D 5/025 60/805
2018/0202460 A1 * 7/2018 Kray ..... F01D 21/045
2018/0290334 A1 10/2018 Corsmeier
2018/0290391 A1 10/2018 Corsmeier
2019/0360351 A1 11/2019 Walston et al.

OTHER PUBLICATIONS

Communication pursuant to Rules 69 EPC and 70a(1) EPC from counterpart European Application No. 19169441.3, dated Dec. 9, 2019, 2 pp.
U.S. Appl. No. 62/537,642, by Jun Shi et al., filed Jul. 27, 2017.
U.S. Appl. No. 62/537,653, by Jun Shi et al., filed Jul. 27, 2017.
Response to Extended Search Report dated Dec. 9, 2019, from counterpart European Application No. 15155665.1, filed May 12, 2020, 76 pp.

* cited by examiner

TAPERED ABRADABLE COATINGS

TECHNICAL FIELD

The present disclosure generally relates to abradable coatings.

BACKGROUND

Components of high-performance systems, such as, for example, turbine or compressor components, operate in severe environments. For example, turbine blades, vanes, blade tracks, and blade shrouds exposed to hot gases in commercial aeronautical engines may experience surface temperatures of about 1000° C.

High-performance systems may include rotating components, such as blades, rotating adjacent a surrounding structure, for example, a shroud. Reducing the clearance between rotating components and a shroud may improve the power and the efficiency of the high-performance component. The clearance between the rotating component and the shroud may be reduced by coating the blade shroud with an abradable coating. In this way, a rotating part, for example, a turbine blade, can abrade a portion of a fixed abradable coating applied on an adjacent stationary part as the turbine blade rotates. Over many rotations, this may wear a groove in the abradable coating corresponding to the path of the turbine blade. The abradable coating may thus form an abradable seal that can reduce the clearance between rotating components and an inner wall of an opposed shroud, which can reduce leakage around a tip of the rotating part or guide leakage flow of a working fluid, such as steam or air, across the rotating component, and enhance power and efficiency of the high-performance component.

SUMMARY

The disclosure describes articles, systems, and techniques relating to tapered abradable coatings. In some examples, an abradable coating may include one or more tapered portions. For example, an abradable coating may be on a substrate and may include one or more tapered portions that substantially continuously taper from a center portion of the substrate to a leading edge, trailing edge, or another side of the substrate. Such tapered portions may reduce a thermal gradient across a surface of the abradable coating and/or the substrate, which in turn may reduce the thermal stress on an article including the substrate and the abradable coating. The reduction in thermal stress may reduce spallation and/or delamination of the abradable coating, while also providing protection for the substrate in a high-temperature environment.

In one example, a system includes a blade including a blade tip and a blade track or blade shroud segment including a substrate and an abradable coating layer on the substrate. The substrate defines a leading edge and a trailing edge. The abradable coating layer includes a first tapered portion that substantially continuously tapers in a direction perpendicular to the leading edge or the trailing edge from a center portion of the substrate toward the leading edge of the substrate, a second tapered portion that substantially continuously tapers in a direction perpendicular to the leading edge or the trailing edge from the center portion of the substrate toward the trailing edge of the substrate, and a blade rub portion that extends between the first tapered portion and the second tapered portion. The abradable coating extends from the leading edge to the trailing edge, and the blade tip is configured to contact at least a portion of the blade rub portion upon rotation of the blade.

In another example, a system includes a blade including a blade tip and a blade track or blade shroud including a substrate and an abradable coating layer on the substrate. The substrate defines an intersegment edge and an opposing edge. The intersegment edge is adjacent to a segment of another blade shroud of the gas turbine engine. The abradable coating layer defines a tapered portion that substantially continuously tapers from the center portion of the substrate to the intersegment edge and a non-tapered portion that extends from the tapered portion to the opposing edge of the substrate. The blade tip is configured to engage the tapered portion prior to engaging the non-tapered portion upon rotation of the blade in a circumferential direction.

In yet another example, a method includes receiving a geometry of a substrate, where the substrate defines a first edge and a second edge and determining a target thickness of a blade rub portion of an abradable coating layer, where at least a portion of the blade rub portion is configured to contact a blade tip of a blade upon rotation of the blade in a circumferential direction. The method further includes determining a number of coating passes or velocity of a coating device to achieve the target thickness and applying the abradable coating layer on the substrate. The abradable coating layer is applied on the substrate to define at least one tapered portion that substantially continuously tapers in a direction perpendicular to the first edge or the second edge from a center portion of the substrate toward the first edge or the second edge of the substrate and the blade rub portion.

The details of one or more examples of the disclosure are set forth in the accompanying drawings and the description below. Other features, objects, and advantages of the disclosure will be apparent from the description and drawings, and from the claims.

DETAILED DESCRIPTION

Figure 1:
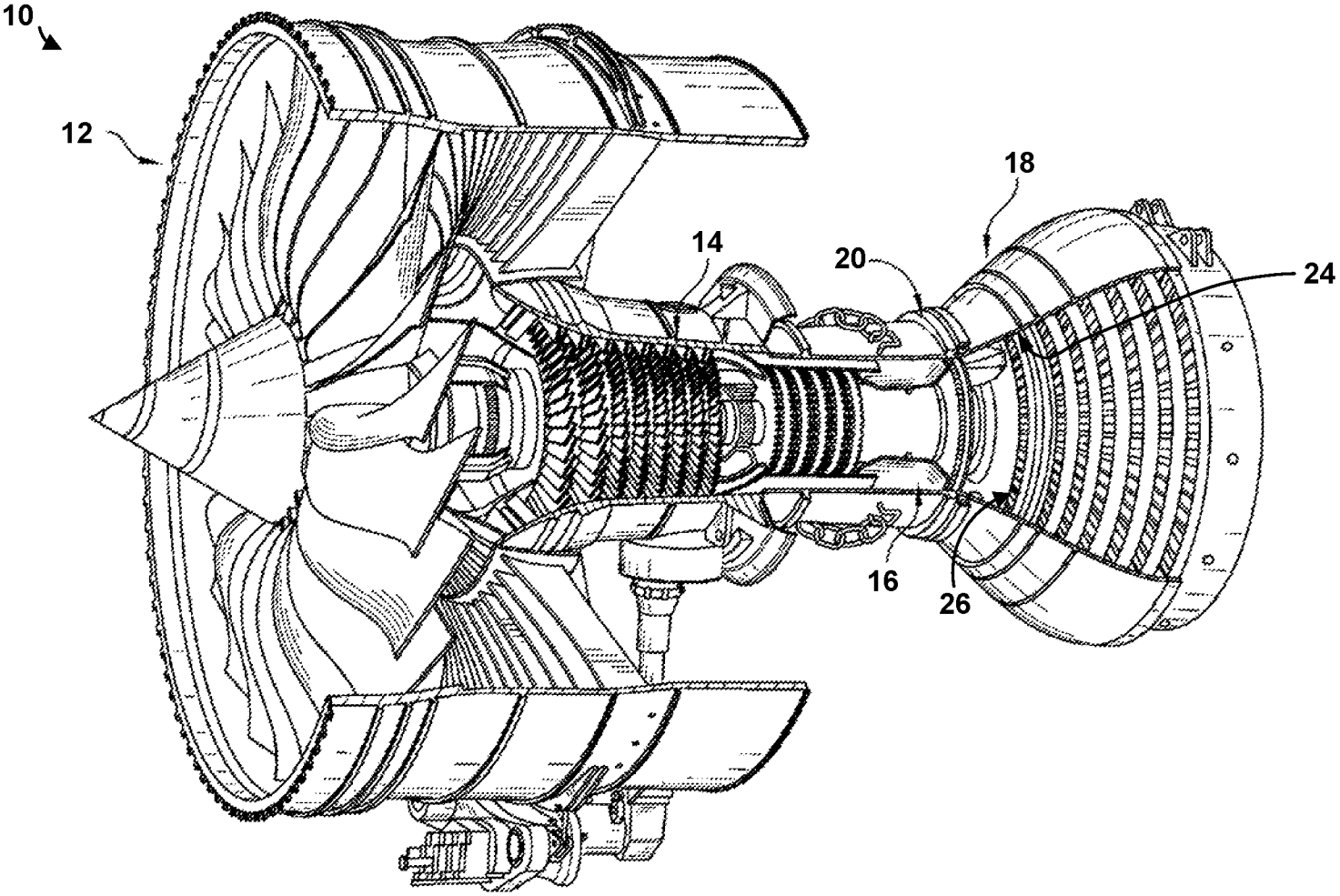
FIG. 1 is cut-away view illustrating an example gas turbine engine.

The disclosure describes articles, systems, and techniques relating to tapered abradable coatings. The abradable coatings may be on a substrate, such as a gas turbine engine shroud or blade track. The abradable coatings described herein include one or more tapered portions. For example, an abradable coating may include a first tapered portion that substantially continuously tapers from a center portion of the substrate toward a leading edge of the substrate, a second tapered portion that substantially continuously tapers from the center portion toward a trailing edge of the substrate, or both.

A gas turbine engine shroud or blade track may experience different temperatures during use along the leading edge-trailing edge direction. As used herein, the leading edge is the most upstream portion of the shroud or blade track and the trailing edge is the most downstream portion of the shroud or blade track. For example, a blade rub portion of the abradable coating may be relatively hot compared to portions of the abradable coating adjacent to the leading and trailing edges due to different cooling gas flow at different portions of the abradable coating. If the abradable coating is a constant thickness on the blade shroud or blade track between the leading edge and the trailing edge, the cooling air in combination with the constant thickness abradable coating may reduce the heat input at the leading edge and trailing edge of the substrate in comparison to the blade rub portion. This may cause stresses in the abradable coating and the substrate due to differential thermal expansion between the various portions. Thermal stress on the article may lead to spallation and/or delamination of the abradable coating, or otherwise lessen the useful life of the abradable coating and/or substrate.

The abradable coatings described herein, which include one or more substantially continuous tapered portions from the center of the substrate to the trailing edge, leading edge, or both may reduce the thermal gradient along the surface of the abradable coating and/or the substrate, thus reducing thermal stress on the abradable coating and/or substrate, likelihood of spallation or delamination of the abradable coating, time and cost to manufacture the coating, or the like.

In some examples, in addition to or instead of being tapered toward the leading edge, trailing edge, or both, an abradable coating may include a tapered portion that substantially continuously tapers from a center portion of a substrate to an intersegment edge of the substrate adjacent to a segment of another blade shroud. This taper may reduce an impact force of the gas turbine engine blade on the abradable coating as the blade transitions from one segment of a shroud or blade track to a circumferentially adjacent segment. This may reduce a likelihood of unintended damage to the abradable coating or blade, such as removal of extra portions of the abradable coating due to the impact force. The tapers to the leading edge, trailing edge, or intersegment edge may be used individually or in any combination.

FIG. 1 is cut-away view illustrating an example gas turbine engine 10. Gas turbine engine 10 includes a fan 12, a compressor section 14, a combustor 16, and a turbine section 18 mounted to a case 20. Fan 12 is driven by turbine section 18 and provides a portion of the thrust for propelling a vehicle (not shown), such as an air vehicle. Compressor section 14 is configured compress and deliver air to combustor 16, and combustor 16 is configured to mix fuel with the compressed air and ignite the fuel. A combustion reaction in combustor 16 generates hot, high-pressure products that are directed into turbine section 18. Turbine section 18 then extracts work to drive compressor section 14 and fan 12. Turbine section 18 includes one or more stages, and each stage includes a plurality of blades surrounded by a blade track or shroud. A single blade 26 and blade shroud segment 24 are labelled for clarity.

Figure 2A:
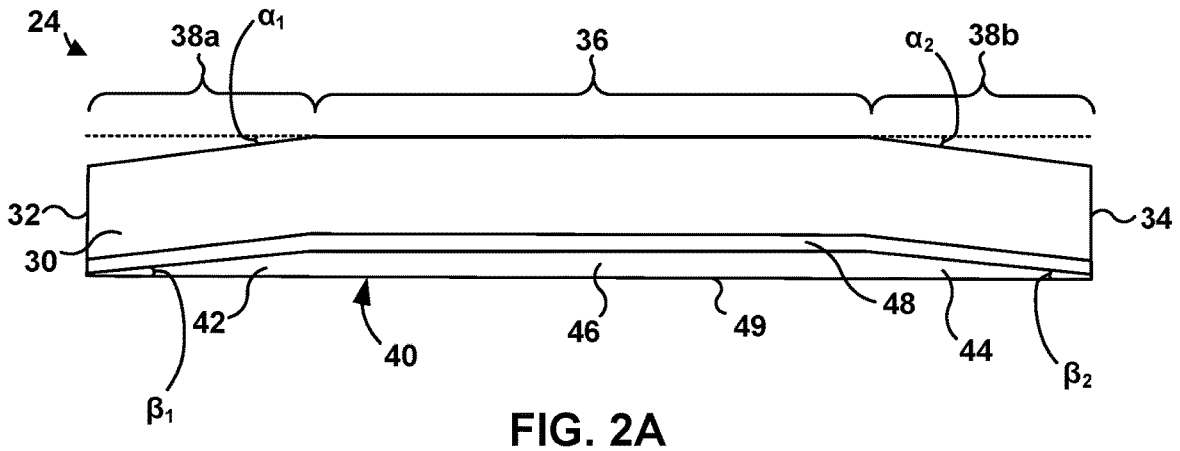
FIG. 2A is conceptual diagram illustrating an enlarged cross-sectional view of the example blade shroud of FIG. 1 including a substrate and a tapered abradable coating layer.

FIG. 2A is conceptual diagram illustrating an enlarged cross-sectional view of the example blade shroud segment 24 of FIG. 1 including a substrate 30 and a tapered abradable coating layer 40. The cross-sectional view of FIG. 2A is taken along the major axis of gas turbine engine 10, extending from the intake of gas turbine engine 10 to the exhaust of gas turbine engine 10, i.e., FIG. 2A is a longitudinal or axial cross-sectional view. Although blade shroud segment 24 is described with respect to a blade shroud of turbine 18 of gas turbine engine 10, in other examples, blade shroud segment 24 may be part of an additional or alternative portion of gas turbine engine 10 (e.g., a high-pressure compressor stage or the like).

Substrate 30 may include a material suitable for use in a high-temperature environment. In some examples, substrate 30 includes a superalloy including, for example, an alloy based on Ni, Co, Ni/Fe, or the like. In examples in which substrate 30 includes a superalloy material, substrate 30 may also include one or more additives such as titanium (Ti), cobalt (Co), or aluminum (Al), which may improve the mechanical properties of substrate 30 including, for example, toughness, hardness, temperature stability, corrosion resistance, oxidation resistance, or the like.

In some examples, substrate 30 may include a ceramic or a ceramic matrix composite (CMC). Suitable ceramic materials may include, for example, a silicon-containing ceramic, such as silica ($SiO_2$) and/or silicon carbide (SiC); silicon nitride ($Si_3N_4$); alumina ($Al_2O_3$); an aluminosilicate; a transition metal carbide (e.g., WC, $Mo_2C$, TiC); a silicide (e.g., $MoSi_2$, $NbSi_2$, $TiSi_2$); combinations thereof; or the like. In some examples in which substrate 30 includes a ceramic, the ceramic may be substantially homogeneous. In examples in which substrate 30 includes a CMC, substrate 30 may include a matrix material and a reinforcement material. The matrix material and reinforcement materials may include, for example, any of the ceramics described herein. The reinforcement material may be continuous or discontinuous. For example, the reinforcement material may include discontinuous whiskers, platelets, fibers, or particulates. Additionally, or alternatively, the reinforcement material may include a continuous monofilament or multifilament two-dimensional or three-dimensional weave, braid, fabric, or the like. In some examples, the CMC includes a SiC matrix material (alone or with residual Si metal) and an SiC reinforcement material.

Substrate 30 defines a leading edge 32 and a trailing edge 34. In some examples, leading edge 32 and trailing edge 34 may be substantially parallel to each other. In other examples, leading edge 32 and trailing edge 34 may not be substantially parallel to each other. In some cases, a first axis extending between leading edge 32 and trailing edge 34 may be in a substantially axial direction of gas turbine engine 10 (e.g., parallel to the axis extending from the intake to the exhaust of gas turbine engine 10). Thus, in some such cases, leading edge 32 and trailing edge 34 may be perpendicular or substantially perpendicular to the axial direction of gas turbine engine 10.

In the example of FIG. 2A, substrate 30 includes a first inclined portion 38*a* and a second inclined portion 38*b*. First inclined portion 38*a* and second inclined portion 38*b* may be inclined relative to a center portion 36 of substrate 30. For example, first inclined portion 38*a* may be inclined relative to center portion 36 at a first angle $\alpha_1$. In some examples, first angle $\alpha_1$ may be between about 1° and about 30°, or between about 15° and about 30°. Similarly, second inclined portion 38*b* may be inclined relative to center portion 36 at a second angle $\alpha_2$. In some cases, second angle $\alpha_2$ may be between about 1° and about 30°, or between about 15° and about 30°. In some examples, first angle $\alpha_1$ and second angle $\alpha_2$ may be substantially the same. In other examples, first angle $\alpha_1$ and second angle $\alpha_2$ may be inclined relative to center portion 36 at different angles. In some cases, one or both of first inclined portion 38*a* or second inclined portion 38*b* may be angled relative to substrate 30 at a non-constant angle. For instance, first angle $\alpha_1$ and/or second angle $\alpha_2$ may gradually change along substrate 30. In this way, first and second tapered portions 42 and 44 may not have continuous rates or degrees of taper, but the tapers are still relatively gradual and continuous from center portion 36 to leading edge 32 or trailing edge 34, respectively, in comparison to a substrate including stepped pockets.

In this way, tapered abradable coating layer 40 on substrate 30 may taper along first inclined portion 38*a* from center portion 36 to leading edge 32 of substrate 30 and along second inclined portion 38*b* from center portion 36 to trailing edge 34 of substrate 30. First inclined portion 38*a* and second inclined portion 38*b* may form a substantially continuous taper from center portion 36 to the leading edge 32 and the trailing edge 34, respectively, of substrate 30. Thus, substrate 30 including first and second inclined portions 38*a*, 38*b* includes relatively gradual inclined surfaces in comparison to substrates including a stepped surface to form a pocket, which may make the article more aerodynamic, decrease stress on the article, reduce or substantially prevent concentrated thermal gradients or mechanical stresses, or combinations thereof.

Moreover, in some examples, substrate 30 including first and second inclined portions 38*a*, 38*b* may be easier to manufacture than some substrates including a stepped surface to form a pocket in the substrate. For instance, in a lay-up technique to manufacture substrate 30, tape and/or fabric material is laid up to create the shape of substrate 30. In examples in which a substrate includes a stepped surface to form a pocket, the tape and/or fabric would have to be bent at relatively sharp angles to create the stepped pocket, which may cause the tape and/or fabric to break, crack, delaminate, or the like either during layup or later due to residual stress in the tape and/or fabric. In examples in which substrate 30 includes first and second inclined portions 38*a*, 38*b* that are relatively gradual tapers in comparison to a stepped surface, the tape and/or fabric may not have to be bent at such sharp angles, which may help prevent the tape and/or fabric from breaking, cracking, and/or delaminating.

In some examples, blade shroud segment 24 optionally includes an intermediate coating 48 between substrate 30 and tapered abradable coating 40. For example, intermediate coating 48 may include at least one of a bond coat, an environmental barrier coating (EBC) layer, or a thermal barrier coating (TBC) layer. In some examples, a single intermediate coating 48 may perform two or more of these functions. For example, an EBC layer may provide environmental protection, thermal protection, and calcia-magnesia-alumina-silicate (CMAS)-resistance to substrate 30. In some examples, instead of including a single intermediate coating 48, blade shroud segment 24 may include a plurality of intermediate coatings, such as at least one bond coat, at least one EBC layer, at least one TBC layer, or combinations thereof.

Intermediate coating 48 including a bond coat may improve adhesion between substrate 30 and an overlying layer, such as tapered abradable coating layer 40. The bond coat may include any suitable material configured to improve adhesion between substrate 30 and tapered abradable coating layer 40. In some examples, intermediate coating 48 may include additional layers between a bond coat and tapered abradable coating layer 40. In such examples, the composition of the bond coat may be selected to increase adhesion between substrate 30 and the layer that is on the bond coat.

In examples in which substrate 30 includes a superalloy, a bond coat may include an alloy, such as an MCrAlY alloy (where M is Ni, Co, or NiCo), a β-NiAl nickel aluminide alloy (either unmodified or modified by Pt, Cr, Hf, Zr, Y, Si, or combinations thereof), a γ-Ni+γ'-$Ni_3Al$ nickel aluminide alloy (either unmodified or modified by Pt, Cr, Hf, Zr, Y, Si, or combinations thereof), or the like. In examples in which substrate 30 includes a ceramic or CMC, a bond coat may include a ceramic or another material that is compatible with the material from which substrate 30 is formed. For example, the bond coat may include mullite (aluminum silicate, $Al_6Si_2O_{13}$), silicon metal or alloy, silica, a silicide, or the like. The bond coat may further include other elements, such as a rare earth silicate including a silicate of lutetium (Lu), ytterbium (Yb), thulium (Tm), erbium (Er), holmium (Ho), dysprosium (Dy), gadolinium (Gd), terbium (Tb), europium (Eu), samarium (Sm), promethium (Pm), neodymium (Nd), praseodymium (Pr), cerium (Ce), lanthanum (La), yttrium (Y), and/or scandium (Sc).

In examples in which intermediate coating 48 includes an EBC layer, the EBC layer may include at least one of a rare-earth oxide, a rare-earth silicate, an aluminosilicate, or an alkaline earth aluminosilicate. For example, an EBC layer may include mullite, barium strontium aluminosilicate (BSAS), barium aluminosilicate (BAS), strontium aluminosilicate (SAS), at least one rare-earth oxide, at least one rare-earth monosilicate ($RE_2SiO_5$, where RE is a rare-earth element), at least one rare-earth disilicate ($RE_2Si_2O_7$, where RE is a rare-earth element), or combinations thereof. The rare-earth element in the at least one rare-earth oxide, the at least one rare-earth monosilicate, or the at least one rare-earth disilicate may include at least one of Lu, Yb, Tm, Er, Ho, Dy, Tb, Gd, Eu, Sm, Pm, Nd, Pr, Ce, La, Y, or Sc.

In some examples, an EBC layer may include at least one rare-earth oxide and alumina, at least one rare-earth oxide and silica, or at least one rare-earth oxide, silica, and alumina. In some examples, an EBC layer may include an additive in addition to the primary constituents of the EBC layer. For example, the additive may include at least one of $TiO_2$, $Ta_2O_5$, $HfSiO_4$, an alkali metal oxide, or an alkali earth metal oxide. The additive may be added to the EBC layer to modify one or more desired properties of the EBC layer. For example, the additive components may increase or decrease the reaction rate of the EBC layer with CMAS, may modify the viscosity of the reaction product from the reaction of CMAS and the EBC layer, may increase adhesion of the EBC layer to substrate 30 and/or another coating layer, may increase or decrease the chemical stability of the EBC layer, or the like.

In some examples, the EBC layer may be substantially free (e.g., free or nearly free) of hafnia and/or zirconia.

Zirconia and hafnia may be susceptible to chemical attack by CMAS, so an EBC layer substantially free of hafnia and/or zirconia may be more resistant to CMAS attack than an EBC layer that includes zirconia and/or hafnia. An EBC layer may be a substantially dense layer, e.g., may include a porosity of less than about 10 vol. %, measured as a fraction of open space compared to the total volume of the EBC layer using, for example, mercury porosimetry, optical microscopy, a method based on Archimedes' principle, e.g., a fluid saturation technique, or the like. The EBC layer may also provide resistance to CMAS.

Additionally, or alternatively, intermediate coating 48 may include a TBC layer. The TBC layer may have a low thermal conductivity (e.g., both an intrinsic thermal conductivity of the material(s) that forms the TBC layer and an effective thermal conductivity of the TBC layer as constructed) to provide thermal insulation to substrate 30 and/or another coating layer of intermediate coating 48. In some examples, a TBC layer may include a zirconia- or hafnia-based material, which may be stabilized or partially stabilized with one or more oxides. In some examples, the inclusion of rare-earth oxides such as ytterbia, samaria, lutetia, scandia, ceria, gadolinia, neodymia, europia, yttria-stabilized zirconia (YSZ), zirconia stabilized by a single or multiple rare-earth oxides, hafnia stabilized by a single or multiple rare-earth oxides, zirconia-rare-earth oxide compounds, such as $RE_2Zr_2O_7$ (where RE is a rare-earth element), hafnia-rare-earth oxide compounds, such as $RE_2Hf_2O_7$ (where RE is a rare-earth element), and the like may help decrease the thermal conductivity of the TBC layer. In some examples, a TBC layer may include a base oxide including zirconia or hafnia, a first rare earth oxide including ytterbia, a second rare earth oxide including samaria, and a third rare earth oxide including at least one of lutetia, scandia, ceria, neodymia, europia, or gadolinia. A TBC layer may include porosity, such as a columnar or microporous microstructure, which may contribute to relatively low thermal conductivity of the TBC layer.

Intermediate coating 48 may be formed on substrate 30 using, for example, thermal spraying, e.g., air plasma spraying, high velocity oxy-fuel (HVOF) spraying, low vapor plasma spraying, suspension plasma spraying; physical vapor deposition (PVD), e.g., electron beam physical vapor deposition (EB-PVD), directed vapor deposition (DVD), cathodic arc deposition; chemical vapor deposition (CVD); slurry process deposition; sol-gel process deposition; electrophoretic deposition; or the like.

Blade shroud segment 24 includes tapered abradable coating layer 40 on substrate 30. Tapered abradable coating 40 may extend from leading edge 32 to trailing edge 34 of substrate 30. Tapered abradable coating layer 40, or at least a portion of tapered abradable coating layer 40, may be configured to be abraded, e.g., by a blade of a gas turbine engine, in order to form a relatively tight seal between blade shroud segment 24 and the blade. Abradability may include a disposition to break into relatively small pieces when exposed to a sufficient physical force. Abradability may be influenced by the material characteristics of the material forming tapered abradable coating layer 40, such as fracture toughness and fracture mechanism (e.g., brittle fracture), as well as the porosity of tapered abradable coating layer 40.

Tapered abradable coating layer 40 may include any suitable material. For example, tapered abradable coating layer 40 may be formed from materials that exhibit a hardness that is relatively lower than a hardness of a blade tip of a rotating blade such that the blade tip can abrade tapered abradable coating layer 40 by contact. Thus, the hardness of tapered abradable coating layer 40 relative to the hardness of the blade tip may be indicative of the abradability of tapered abradable coating layer 40.

In some examples, tapered abradable coating layer 30 may include a matrix composition. Such a matrix composition of tapered abradable coating layer 40 may include at least one of aluminum nitride, aluminum diboride, boron carbide, aluminum oxide, mullite, zirconium oxide, carbon, silicon carbide, silicon nitride, silicon metal, silicon alloy, a transition metal nitride, a transition metal boride, a rare earth oxide, a rare earth silicate, zirconium oxide, a stabilized zirconium oxide (for example, yttria-stabilized zirconia), a stabilized hafnium oxide (for example, yttria-stabilized hafnia), barium-strontium-aluminum silicate, or combinations thereof. In some examples, tapered abradable coating layer 40 includes at least one silicate, which may refer to a synthetic or naturally-occurring compound including silicon and oxygen. Suitable silicates include, but are not limited to, rare earth disilicates, rare earth monosilicates, barium strontium aluminum silicate, or combinations thereof.

In some cases, tapered abradable coating layer 40 may include a base oxide of zirconia or hafnia and at least one rare earth oxide, such as, for example, oxides of Lu, Yb, Tm, Er, Ho, Dy, Gd, Tb, Eu, Sm, Pm, Nd, Pr, Ce, La, Y, and Sc. For example, tapered abradable coating layer 40 may include predominately (e.g., the main component or a majority) the base oxide zirconia or hafnia mixed with a minority amounts of the at least one rare earth oxide. In some examples, tapered abradable coating layer 40 may include the base oxide and a first rare earth oxide including ytterbia, a second rare earth oxide including samaria, and a third rare earth oxide including at least one of lutetia, scandia, ceria, neodymia, europia, or gadolinia. In some examples, the third rare earth oxide may include gadolinia such that tapered abradable coating layer 40 may include zirconia, ytterbia, samaria, and gadolinia.

Tapered abradable coating layer 40 may optionally include other elements or compounds to modify a desired characteristic of the coating layer, such as, for example, phase stability, thermal conductivity, or the like. Example additive elements or compounds include, for example, rare earth oxides. The inclusion of one or more rare earth oxides, such as ytterbia, gadolinia, and samaria, within a layer of predominately zirconia may help decrease the thermal conductivity of tapered abradable coating layer 40, e.g., compared to a composition including zirconia and yttria.

While the abradability of tapered abradable coating layer 40 may depend on the respective composition of the layer, for example, the physical and mechanical properties of the composition, the abradability of the layer may also depend on a porosity of the layer. For example, a relatively porous composition may exhibit a higher abradability compared to a relatively nonporous composition, and a composition with a relatively higher porosity may exhibit a higher abradability compared to a composition with a relatively lower porosity, everything else remaining the same. Moreover, a relatively porous tapered abradable coating layer 40 may have a decreased thermal conductivity in comparison to a coating layer with a relatively lower porosity or a dense microstructure.

Thus, in some examples, tapered abradable coating layer 40 may include a plurality of pores. The plurality of pores may include at least one of interconnected voids, unconnected voids, partly connected voids, spheroidal voids, ellipsoidal voids, irregular voids, or voids having any predetermined geometry, or networks thereof. In some examples, tapered abradable coating layer 40 may exhibit a porosity between about 10 vol. % and about 50 vol. %, between about 10 vol. % and about 40 vol. %, between about 15 vol. % and 35 vol. %, or about 25 vol. %, where porosity is measured as a percentage of pore volume divided by total volume of tapered abradable coating layer 40. The porosity of tapered abradable coating layer 40 may be measured using mercury porosimetry, optical microscopy, a method based on Archimedes' principle, e.g., a fluid saturation technique, or the like.

In some examples, the porosity of tapered abradable coating layer 40 may be created and/or controlled by plasma spraying the coating material using a co-spray process technique in which the coating material and a coating material additive are fed into a plasma stream with two radial powder feed injection ports. For example, a coating material additive that melts or burns at the use temperatures of blade shroud segment 24 may be incorporated into the coating material that forms tapered abradable coating layer 40. The coating material additive may include, for example, graphite, hexagonal boron nitride, or a polymer such as a polyester, and may be incorporated into the coating material prior to deposition of the coating material on substrate 30 to form tapered abradable coating layer 40. The coating material additive then may be melted or burned off in a post-formation heat treatment, or during operation of blade shroud segment 24 (e.g., operation of gas turbine engine 10), to form pores in tapered abradable coating layer 40. The post-deposition heat-treatment may be performed at up to about 1150° C. for a component having a substrate 30 that includes a superalloy, or at up to about 1500° C. for a component having a substrate 30 that includes a CMC or other ceramic.

In other examples, the porosity of tapered abradable coating layer 40 may be created or controlled in a different manner, and/or tapered abradable coating layer 40 may be deposited on substrate 30 using a different technique. For example, tapered abradable coating layer 40 may be deposited using a wide variety of coating techniques, including, for example, thermal spraying, e.g., air plasma spraying, HVOF spraying, low vapor plasma spraying, suspension plasma spraying; PVD, e.g., EB-PVD, DVD, or cathodic arc deposition; CVD; slurry process deposition; sol-gel process deposition; electrophoretic deposition; or the like.

As seen in FIG. 2A, tapered abradable coating layer 40 includes a first tapered portion 42 and a second tapered portion 44. Tapered abradable coating layer 40 also includes a blade rub portion 46 that extends between first tapered portion 42 and second tapered portion 44. In some examples, at least a portion of blade rub portion 46 may be configured to be contacted by a blade tip of a blade upon rotation of the blade. In some such examples, the blade tip may be configured to abrade a portion of blade rub portion 46.

Figure 2B:
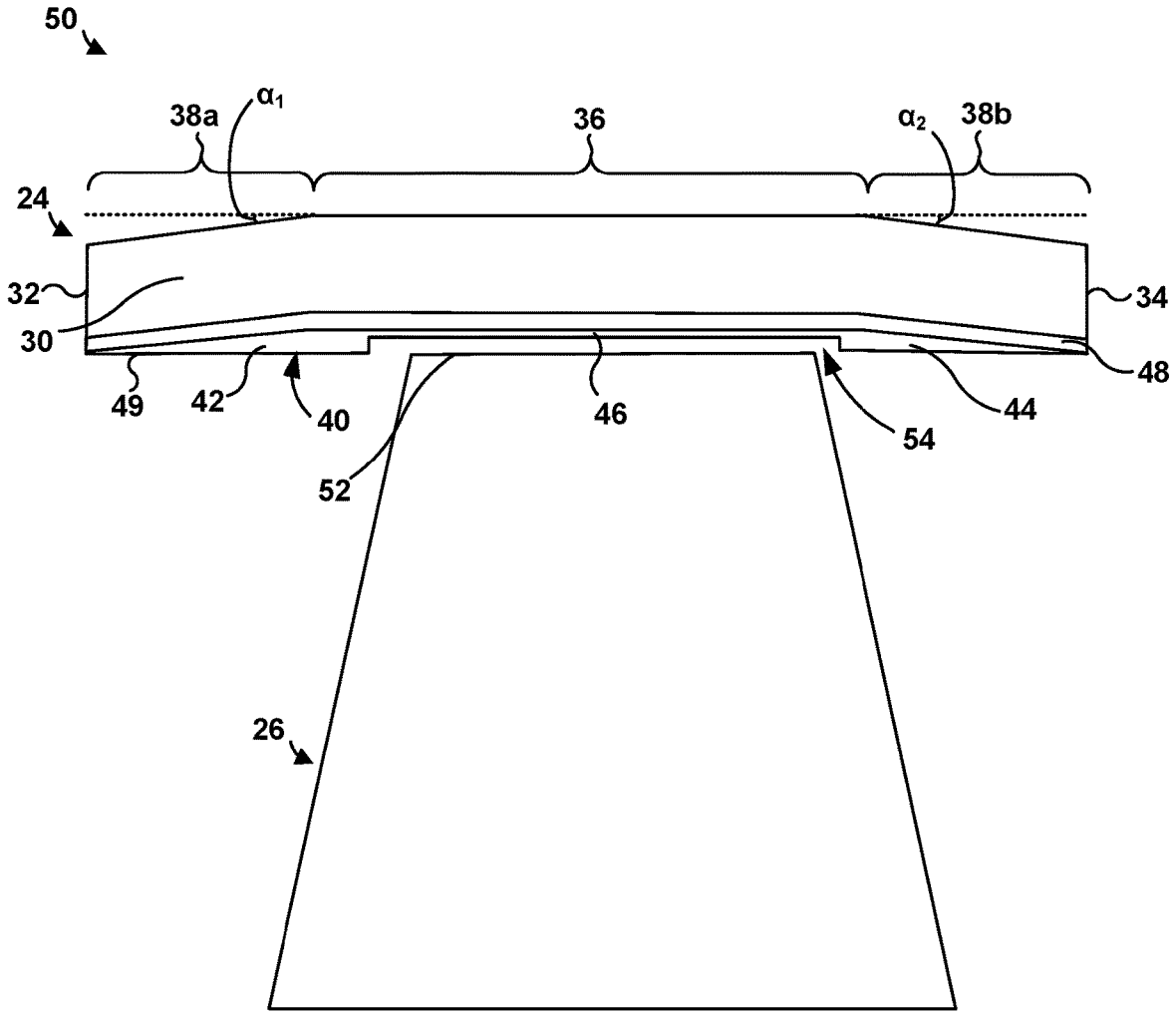
FIG. 2B is conceptual diagram illustrating an enlarged cross-sectional view of a system including the example blade shroud of FIGS. 1 and 2A and the blade of FIG. 1.

FIG. 2B is conceptual diagram illustrating an enlarged cross-sectional view of a system 50 including the example blade shroud segment 24 of FIGS. 1 and 2A and blade 26 of FIG. 1. Like the cross-sectional view of FIG. 2A, the cross-sectional view of FIG. 2B is taken along the major axis of gas turbine engine 10, extending from the intake of gas turbine engine 10 to the exhaust of gas turbine engine 10, i.e., FIG. 2B is a longitudinal or axial cross-sectional view. Blade shroud segment 24 shown in FIG. 2B is substantially the same as blade shroud segment 24 shown in FIG. 2A, except FIG. 2B illustrates a part of blade rub portion 46 that has been abraded by blade tip 52 of blade 26 to form a blade path 54 in tapered abradable coating layer 40.

Because first tapered portion 42 and second tapered portion 44 are not configured to be abraded by blade tip 52 (e.g., are not positioned relative to blade 26 such that blade tip 52 contacts first tapered portion 42 or second tapered portion 44), first and second tapered portions 42, 44 may not require a coating thickness as thick as a coating thickness of blade rub portion 46. Rather, as discussed above, a constant thickness abradable coating extending from leading edge 32 to trailing edge 34 of substrate 30 may result in a relatively large thermal gradient across substrate 30, resulting in stress in substrate 30 and abradable coating layer 40. Thus, a minimum thickness of first tapered portion 42 and/or second tapered portion 44 may be any thickness greater than 0 mm, such as, for example a minimum thickness greater than about 0.075 mm (about 0.003 inches). In some cases, first tapered portion 42 may define the respective minimum thickness at or near leading edge 32, and second tapered portion 44 may define the respective minimum thickness at or near trailing edge 34. In this way, the minimum thicknesses of first and second tapered portions 42, 44 may help protect substrate 30 from a severe operating environment of system 22 while reducing the thermal strain (e.g., by locally heating leading edge 32 and trailing edge 34) on blade shroud segment 24 in comparison to a constant thickness abradable coating.

First tapered portion 42 may substantially continuously taper in a direction perpendicular to leading edge 32 and/or trailing edge 34 from center portion 36 of substrate 30 (e.g., beginning at blade rub portion 46) toward leading edge 32 of substrate 30. Similarly, second tapered portion 44 may substantially continuously taper in a direction perpendicular to leading edge 32 and/or trailing edge 34 from center portion 36 of substrate 30 (e.g., beginning at blade rub portion 46) toward trailing edge 34 of substrate 30.

Blade rub portion 46, on the other hand, may define a thickness greater than the minimum thickness of one or both of first tapered portion 42 or second tapered portion 44. For instance, blade rub portion 46 may be thick enough such that blade tip 52 can abrade tapered abradable coating layer 40 to form blade path 54 without contacting and/or abrading an underlying coating layer (e.g., intermediate coating 48) or substrate 30. In some examples, blade rub portion 46 may have a thickness of between about 0.025 mm (about 0.01 inches) and about 3 mm (about 0.12 inches). In other examples, blade rub portion 46 may have other thicknesses. For example, blade rub portion 46 may be any thickness such that blade tip 52 can abrade tapered abradable coating layer 40 to form blade path 54 without contacting and/or abrading an underlying coating layer (e.g., intermediate coating 48) or substrate 30.

In some examples, blade rub portion 46 may be wider than a width of blade tip 52. For example, blade rub portion 46 may define a first width measured along an axial axis extending from leading edge 32 to trailing edge 34 of substrate 30 that is greater than a second width of blade tip 52 measured along the axial axis. In this way, blade tip 52 may be able to form blade path 54 without contacting and/or abrading an underlying coating layer (e.g., intermediate coating 48) or substrate 30. In other examples, the width of blade rub portion 46 may be less than or equal to the width of blade tip 52 (and any potential axial travel of blade tip 52). In turn, blade path 54 formed by blade tip 52 may be substantially continuous with first tapered portion 42 and second tapered portion 44 (e.g., tapered abradable coating layer 40 may be substantially flat from first tapered portion 42 to second tapered portion 44 after blade rub) rather than forming a trenched blade path 54 in blade rub portion 46 as illustrated in FIG. 2B. For example, blade path 54 (or edges of blade path 54) may be substantially coplanar with an edge of first tapered portion 42 and an edge of second tapered portion 44 (e.g., the edges adjacent to blade rub portion 46). In some such examples, the taper angle $\beta_1$, $\beta_2$ or a rate of taper of first and/or second tapered portions 42, 44 may be selected such that blade path 54 formed by blade tip 52 is substantially coplanar with the edges of first and/or second tapered portions 42, 44 adjacent to blade rub portion 46. Thus, in some cases, the taper angle $\beta_1$, $\beta_2$, a rate of taper of first and/or second tapered portions 42, 44, and/or the width of blade rub portion 46 may be selected based on to the width of blade tip 52 (and any potential axial travel of blade tip 52). In some examples, the desired thickness of blade rub portion 46 may be greater than a thickness of blade rub portion in which blade path 54 formed by blade tip 52 is not configured to be substantially coplanar with the edges of first and/or second tapered portions 42, 44.

Moreover, in some examples, tapered abradable coating layer 40 may have a relatively constant thickness within blade rub region 46 (e.g., across the first width of blade rub portion 46). In turn, vibration of blades 26, imperfect circumferential alignment of a plurality of blades 26, inconsistent widths of a plurality of blade tips 52, or the like may still enable formation of blade path 54 without an underlying coating layer (e.g., intermediate coating 48) or substrate 30 being contacted and/or abraded by the blade tips.

Although first and second tapered portions 42, 44 of tapered abradable coating layer 40 are illustrated as substantially linear tapered portions, in other examples, one or both of first and second tapered portions 42, 44 may be substantially non-linear tapered portions. For example, first and second tapered portions 42, 44 may be curved. In a similar manner, one or both of first and second inclined portions 38*a*, 38*b* may be substantially non-linear surfaces, such as, for example, curved surfaces. In other examples, any of first tapered portion 42, second tapered portion 44, first inclined portion 38*a*, and/or second inclined portion 38*b* may be a different shape other than linear or curved. In some examples, a non-linear shape any of first tapered portion 42, second tapered portion 44, first inclined portion 38*a*, and/or second inclined portion 38*b* may be easier or less expensive to manufacture or apply as tapered abradable coating layer 40. Additionally, or alternatively, a non-linear shape of any of first tapered portion 42, second tapered portion 44, first inclined portion 38*a*, and/or second inclined portion 38*b* may allow for a further reduction in the thermal gradient in comparison to a substantially linear shape.

In some examples, tapered abradable coating layer 40 defines a relatively curvilinear exterior surface 56 (e.g., prior to the formation of blade path 54) while still including first and second tapered portions 42, 44 due to the underlying first and second inclined portions 38*a*, 38*b* of substrate 30 (e.g., exterior surface 56 of tapered abradable coating layer 40 itself is not tapered). For example, exterior surface 56 defining a curvilinear surface may be an arc of a cylindrical surface, such as a cylindrical surface defining an axis substantially parallel to a longitudinal axis of a gas turbine engine (e.g., as seen in FIG. 1), of a plurality of blade shroud segments 24 of a blade shroud. Although illustrated as a relatively planar exterior surface 56 in FIGS. 2A and 2B, the curvature of exterior surface 56 (e.g., a curvilinear exterior surface 56) has been omitted for clarity. In other examples, blade shroud segment 24 may define a larger segment, or the entirety, of blade shroud. For example, in some cases, blade shroud segment 24 may define a cylindrical surface, and thus, the exterior surface of tapered abradable coating layer 40 may also define a cylindrical exterior surface. As another example, blade shroud segment 24 or a blade shroud may be non-symmetrical. For instance, blade shroud segment 24 may be a segment of a case of a gas turbine engine with a relatively conical shape, and as such blade shroud segment 24 may define a portion of the relatively conical shape. As yet another example, blade shroud segment 24 and/or the exterior surface 56 of tapered abradable coating layer 40 may be relatively planar. The shape of exterior surface 56 of tapered abradable coating layer 40 may depend on the shape of blade shroud segment 24, which may depend on the shape of case 20, the size of blade shroud segment 24, the number of segments defining the blade shroud, the location of a segment of blade shroud segment 24 with the blade shroud, or the like.

In some examples, a first taper angle $\beta_1$ of first tapered portion 42 may be substantially the same as first angle $\alpha_1$ of first inclined portion 38*a* (e.g., relative to center portion 36) and a second taper angle $\beta_2$ of second tapered portion 44 may be substantially the same as second angle $\alpha_2$ of second inclined portion 38*b* (e.g., relative to center portion 36). Thus, in some such examples, first taper angle $\beta_1$ may be between about 1° and about 30° and second taper angle $\beta_2$ may be between about 1° and about 30°. In some examples, one or both of first taper angle $\beta_1$ and second taper angle $\beta_2$ may be between about 15° and about 30°.

In other examples, tapered abradable coating layer 40 may define a relatively non-curvilinear exterior surface. For example, in some cases, the substrate may have a relatively curvilinear surface (e.g., with no inclined portions) and the tapered abradable coating may have a tapered exterior surface.

Figure 3A:
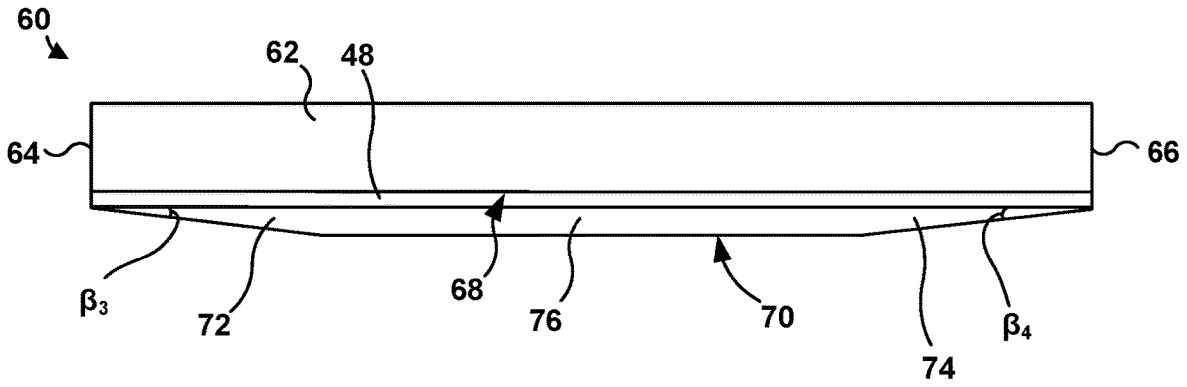
FIG. 3A is conceptual diagram illustrating an enlarged cross-sectional view of another example blade shroud including a substrate and a tapered abradable coating layer.
Figure 3B:
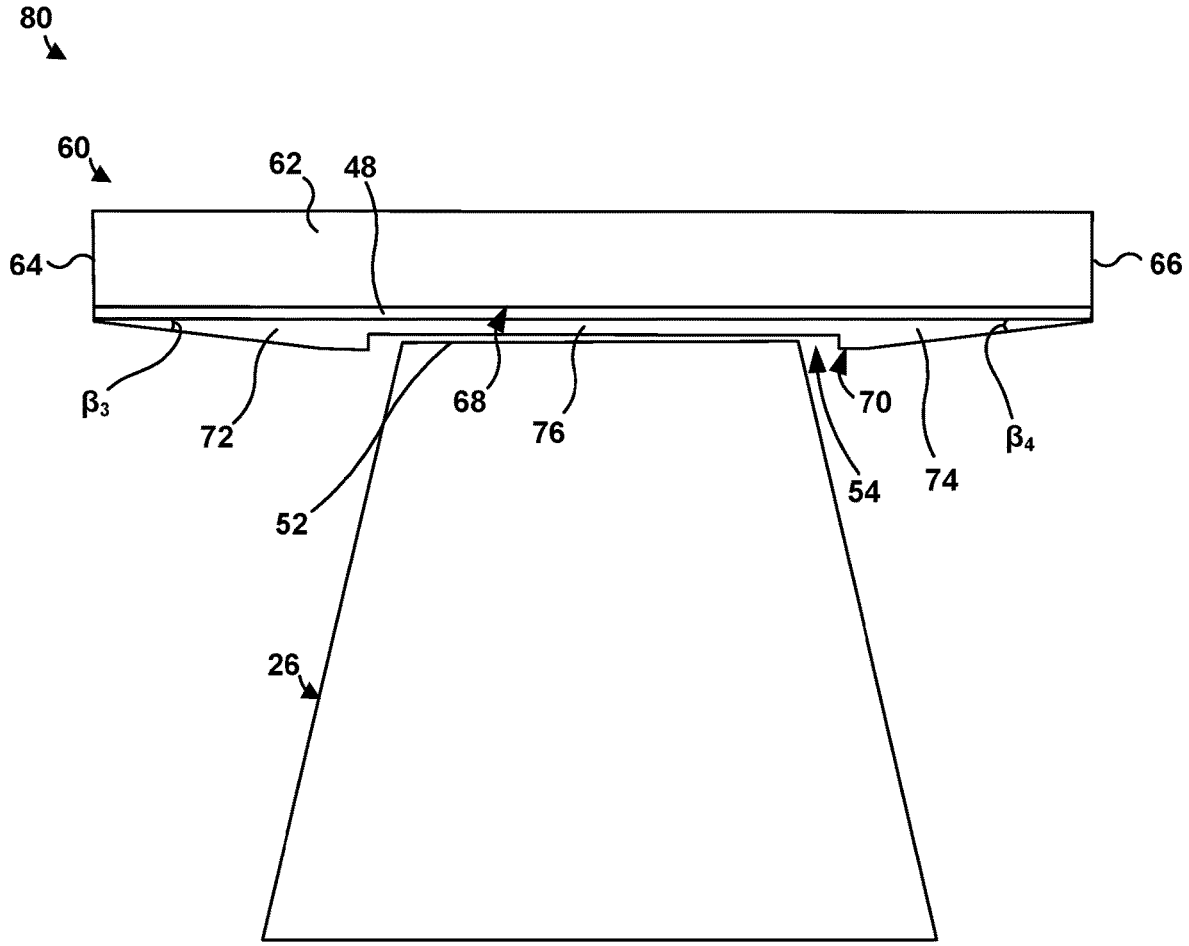
FIG. 3B is conceptual diagram illustrating an enlarged cross-sectional view of a system including the example blade shroud of FIG. 3A and a blade.

FIG. 3A is conceptual diagram illustrating an enlarged cross-sectional view of another example blade shroud segment 60 including a substrate 62 and a tapered abradable coating layer 70. FIG. 3B is conceptual diagram illustrating an enlarged cross-sectional view of a system 80 including the example blade shroud segment 60 of FIG. 3A and a blade 26.

Substrate 62 may be substantially the same as substrate 30 of FIGS. 2A and 2B. For example, substrate 62 includes a leading edge 64 and a trailing edge 66. In addition, substrate 62 may include any of the materials described with respect to substrate 30 above. In the examples of FIGS. 3A and 3B, however, substrate 62 does not include any inclined portions. In this way, substrate 62 may define a substantially curvilinear surface 68 from leading edge 64 to trailing edge 66 (e.g., as a segment of a cylindrical shroud of a gas turbine engine).

Blade shroud segment 60 also includes intermediate coating 48 and a tapered abradable coating layer 70. Intermediate coating 48 may be the same or substantially the same as described with respect to FIGS. 2A and 2B and may include any one or more of the layers described above. Tapered abradable coating layer 70 may be substantially similar to tapered abradable coating layer 40, but may not define a relatively curvilinear exterior surface (e.g., as a segment of a cylindrical shroud) as described with respect to with tapered abradable coating layer 40.

For instance, due to substrate 62 defining a substantially curvilinear surface 68 or another shape that does not include inclined portions, tapered abradable coating layer 70 defines a tapered exterior surface such that tapered abradable coating layer 70 includes a first tapered portion 72 and a second tapered portion 74 rather than a relatively constant surface from leading edge 64 to trailing edge 66. Thus, similar to tapered abradable coating layer 40, tapered abradable coating layer 70 includes first tapered portion 72 that substantially continuously tapers in a direction perpendicular to leading edge 64 or trailing edge 66 from a center portion of the substrate 62 toward leading edge 64 of substrate 62, and includes second tapered portion 74 that substantially continuously tapers in a direction perpendicular to leading edge 64 or trailing edge 66 from the center portion of substrate 62 toward trailing edge 66. In some examples, first tapered portion 72 may define a first taper angle $\beta_1$ between about 1° and about 30°, or between about 15° and about 30°, and second tapered portion 74 may define a second taper angle $\beta_2$ between about 1° and about 30°, or between about 15° and about 30°.

In this way, blade shroud segment 60 may also have a reduced thermal gradient in comparison to a constant thickness abradable coating, as first and second tapered portions 72, 74 may define a minimum thickness, such as a minimum thickness to protect substrate 62 from a severe operating environment, and blade rub portion 76 may define a thickness sufficient to be abraded by blade tip 52 without intermediate coating 48 and/or substrate 62 from be contacted by blade tip 52. In some examples, first tapered portion 72 may have a minimum thickness of greater than 0 mm, such as, at least about 0.075 mm (about 0.003 inches), second tapered portion 74 may have a minimum thickness of greater than 0 mm, such as at least about 0.075 mm (about 0.003 inches), and blade rub portion 76 may have a thickness between about 0.25 mm (about 0.01 inches) and about 3 mm (about 0.12 inches). Moreover, blade shroud segment 60 does not include steps in substrate 62. In turn, blade shroud segment 60 including tapered abradable coating layer 70 may experience reduced thermal stress and/or better distribute stress across blade shroud segment 60, may be more aerodynamic, and/or tapered abradable coating layer 70 may be less likely to spall and/or delaminate in comparison to a constant thickness abradable coating or a substrate including an abradable coating in a pocket of the substrate.

Figure 4A:
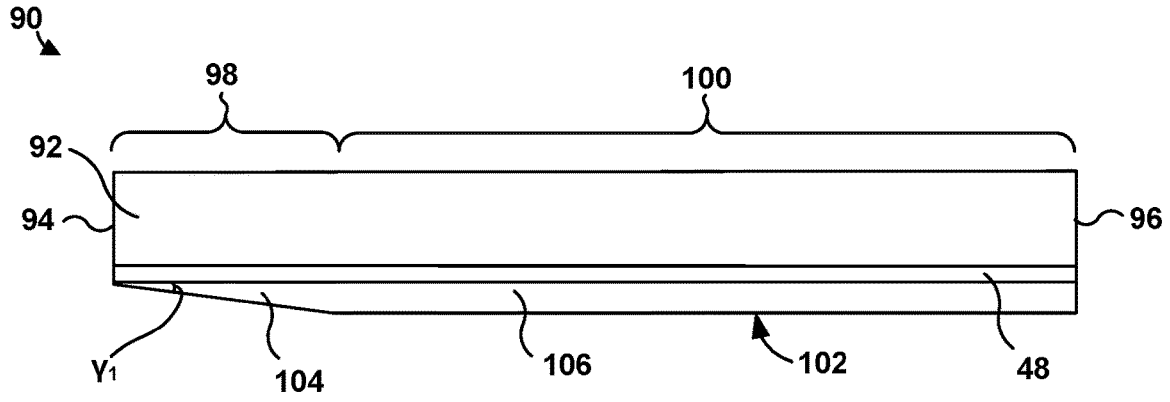
FIG. 4A is a conceptual diagram illustrating an enlarged cross-sectional view of another example blade shroud including a substrate and a tapered abradable coating layer.
Figure 4B:
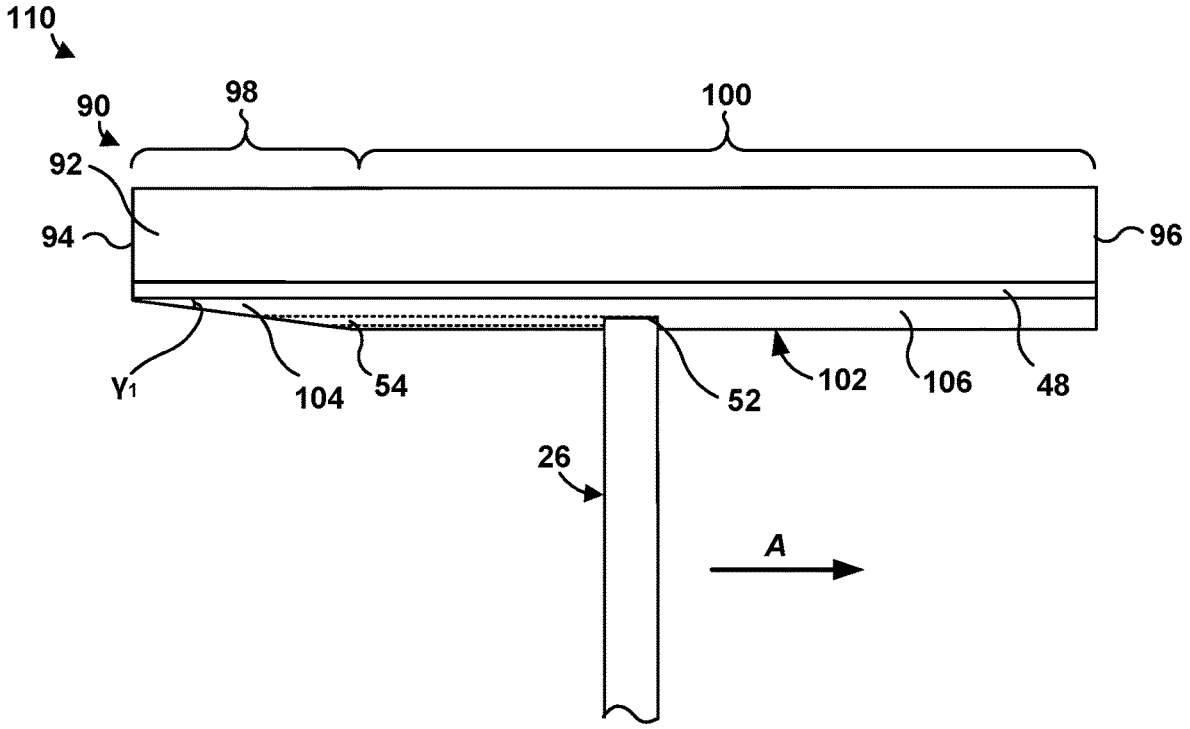
FIG. 4B is conceptual diagram illustrating an enlarged cross-sectional view of a system including the example blade track of FIG. 4A and a blade.

In some examples, in addition to or instead of including an abradable coating layer that tapers from a center portion of a shroud to a leading edge, trailing edge, or both, of the shroud, a shroud or blade track may include an abradable coating layer that tapers from the center portion of the abradable coating layer to an intersegment edge. FIG. 4A is a conceptual diagram illustrating an enlarged cross-sectional view of another example blade shroud segment 90 including a substrate 92 and a tapered abradable coating layer 102. FIG. 4B is conceptual diagram illustrating an enlarged cross-sectional view of a system 110 including the example blade track 90 of FIG. 4A and a blade 26. The cross-sectional views of FIGS. 4A and 4B are taken perpendicular to the longitudinal axis of gas turbine engine 10, i.e., FIGS. 4A and 4B show radial cross-sectional views. Blade shroud segment 90 includes a substrate 92 and tapered abradable coating 102. In some examples, blade shroud segment 90 may also include intermediate coating 48. Substrate 92, tapered abradable coating layer 102, and intermediate coating 48 may be the same or substantially similar to the substrates, tapered abradable coating layers, and intermediate coatings described herein with respect to FIGS. 2A-3B, aside from the differences described herein. For example, substrate 92, tapered abradable coating layer 102, and intermediate coating 48 may be formed from the same or substantially the same materials and/or using the same or substantially the same techniques as described above. In some examples, the examples of FIGS. 4A and 4B may illustrate cross-sectional views of blade shroud segment 24 and system 50 of FIGS. 2A and 2B or blade shroud segment 60 and system 80 of FIGS. 3A and 3B.

Substrate 92 defines an intersegment edge 94 and an opposing edge 96. Intersegment edge 94 may be adjacent to a segment of another blade shroud of a gas turbine engine, e.g., in the direction counter to the rotational direction of the blade (see FIG. 4B). For instance, a gas turbine engine may include a plurality of blade shroud segments in a circumferential arrangement to form the blade shrouds that surround a plurality of blades. Thus, in some cases, opposing edge 96 may also be adjacent to a segment of another blade shroud (e.g., a different segment than intersegment edge 94 is adjacent to in the rotational direction of the blade; see FIG. 4B). That is, upon normal circumferential rotation of blade 26, blade tip 52 may be configured to move in the direction of arrow A as illustrated in FIG. 4B.

Tapered abradable coating layer 102 includes tapered portion 104 and non-tapered portion 106. Tapered portion 104 may substantially continuously taper from a center portion of substrate 92 to intersegment edge 94. Non-tapered portion 106 may extend from tapered portion 104 (e.g., the center portion of substrate 92) to opposing edge 96. In this way, tapered abradable coating layer 102 may extend between intersegment edge 94 and opposing edge 96.

In some examples, tapered abradable coating layer 102 including tapered portion 104 that substantially continuously tapers from the center portion of substrate 92 to intersegment edge 94 may improve a tip rub capability of tapered abradable coating layer 102. For example, because blade 26 moves in the direction of arrow A and may first engage with tapered abradable coating layer 102 near intersegment edge 94, tapered portion 104 results in blade tip 52 gradually engaging with tapered abradable coating layer 102 due to tapered portion 104 at intersegment edge 94. For instance, rather than a blade tip encountering a protruding step of abradable coating layer due to mismatches between adjacent segments of the blade shroud, blade tip 52 may relatively gently engage tapered portion 104 of tapered abradable coating layer 102 a little at a time as blade 26 rotates in the circumferential direction. Therefore, tapered abradable coating layer 102 may reduce impact forces on blade 26 during rotation of the blade 26 (i.e., during transition from one segment of shroud 90 to the next segment of shroud 90). Moreover, because blade tip 52 may engage tapered abradable coating layer 102 a little at a time rather than encountering a larger step of an abradable coating, tapered abradable coating layer 102 and/or blade tip 52 may be able to better endure relatively aggressive tip rub events in comparison to a system including a constant thickness abradable coating.

In some examples, tapered portion 104 may define a minimum thickness of greater than 0 mm (e.g., at least about 0.075 mm (about 0.003 inches)) and non-tapered portion 106 may define a thickness between about 0.25 mm (about 0.01 inches) and about 3 mm (about 0.12 inches). In other examples, tapered portion 104 and/or non-tapered portion 106 may define alternative thicknesses.

In some cases, a width of tapered portion 104 (e.g., measured along an axis extending between a leading edge and a trailing edge of substrate 92) may be less of a width of substrate 92 from the leading edge to the trailing edge. For example, in some cases, the width of tapered portion 104 may be about the width of blade tip 52 (and any potential axial travel of blade tip 52), or slightly greater than the width of blade tip 52 (and any potential axial travel of blade tip 52). In turn, tapered abradable coating layer 102 may reduce an amount of leakage over blade tip 52. Moreover, in examples in which a thermal spray technique is used to apply tapered abradable coating layer 102 on substrate 92, less coating material from which tapered abradable coating layer 102 is formed may be lost during application of the coating layer on substrate 92.

Although illustrated as tapered abradable coating layer 102 including only one tapered portion 104, in other cases, tapered abradable coating layer 102 may include an additional tapered portion that substantially continuously tapers from the center portion of substrate 92 to opposing edge 94. In some such examples, substrate 92 may include an inclined portion that is inclined relative to the center portion from the center portion to opposing edge 94 (e.g., similar to substrate 30 of FIGS. 2A and 2B).

In some examples, a substrate may include a tapered abradable coating layer that includes three or more tapered portions. For instance, a tapered abradable coating layer may taper from a center portion of a substrate toward a leading edge of the substrate, from the center portion of the substrate toward a trailing edge of the substrate, and from the center portion of the substrate toward an intersegment edge of the substrate, as shown in FIG. 5.

Figure 5:
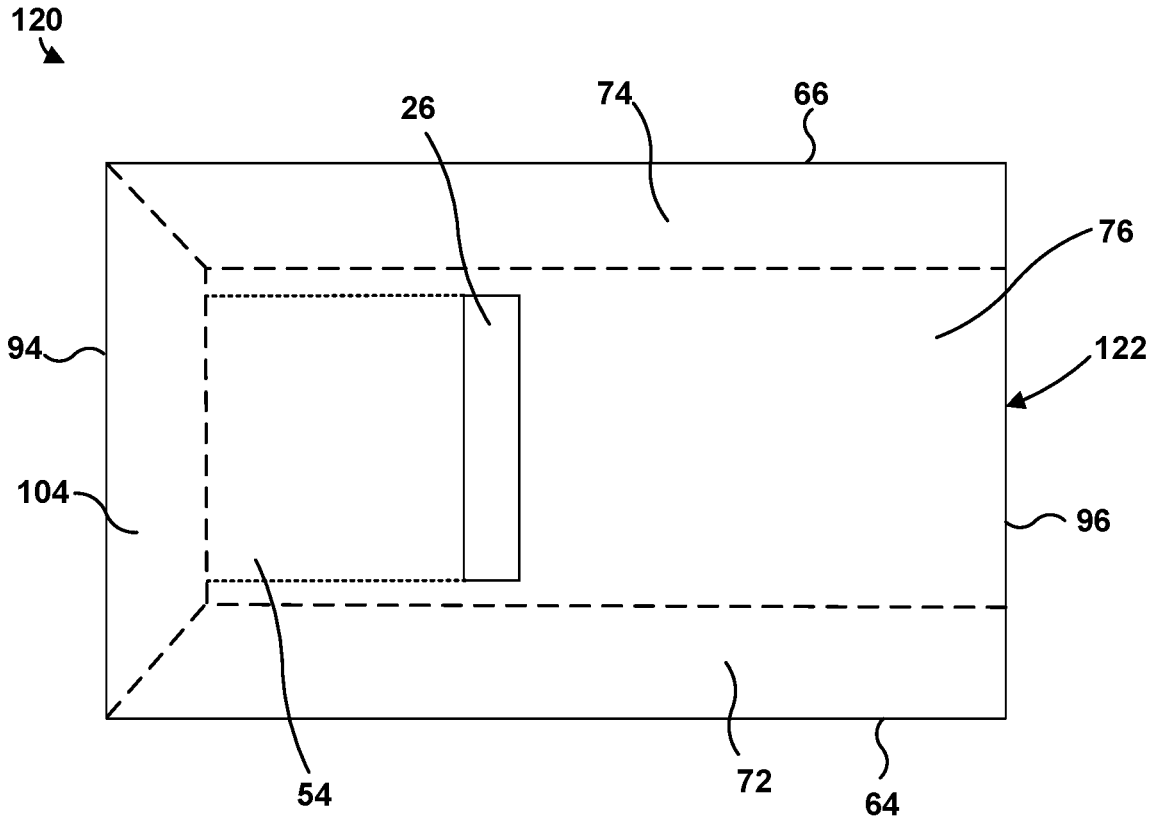
FIG. 5 is a conceptual diagram illustrating a top view of an example system including a tapered abradable coating layer including three tapered portions.

FIG. 5 is a conceptual diagram illustrating a top-down view of an example system 120 including a tapered abradable coating layer 122 including three tapered portions. In some examples, tapered abradable coating layer 122 may be a combination of tapered abradable coating layer 70 of FIGS. 3A and 3B and tapered abradable coating layer 102 of FIGS. 4A and 4B. For example, tapered abradable coating layer 122 includes first tapered portion 72 that substantially continuously tapers from a center portion of a substrate (not shown) to leading edge 64, second tapered portion 74 that substantially continuously tapers from the center portion to trailing edge 66, and a third tapered portion 104 that substantially continuously tapers from the center portion to intersegment edge 94. The center portion of the substrate may extend between leading edge 64, trailing edge 66, intersegment edge 94, and opposing edge 96.

In turn, tapered abradable coating layer 122 including the three tapered portions 72, 74, and 104 may reduce a thermal gradient across the substrate, reduce stress on an article including tapered abradable coating layer 122, and improve the blade rub capability of tapered abradable coating layer 122. Moreover, tapered abradable coating layer 122 may require less coating material to form tapered abradable coating layer 122 in comparison to a constant thickness abradable coating.

In some examples, tapered abradable coating layer 122 may include four or more tapered portions. For example, tapered abradable coating layer 122 may include a fourth tapered portion that substantially continuously tapers from the center portion of the substrate to opposing edge 96 of the substrate. Additionally, or alternatively, tapered abradable coating layer 122 may be a combination of tapered abradable coating layer 40 of FIGS. 2A and 2B and tapered abradable coating layer 102 of FIGS. 4A and 4B, or any other tapered abradable coating layers as described herein, instead of a combination of tapered abradable coating layer 70 of FIGS. 3A and 3B and tapered abradable coating layer 102 of FIGS. 4A and 4B.

Figure 6:
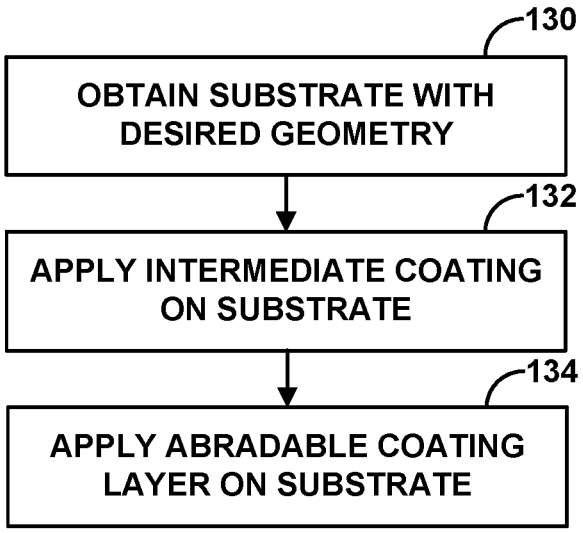
FIG. 6 is a flow diagram illustrating an example technique for forming a blade track or blade shroud that includes a tapered abradable coating layer.

FIG. 6 is a flow diagram illustrating an example technique for forming a blade track or blade shroud that includes a tapered abradable coating layer. The technique of FIG. 6 will be described with respect to blade shroud segment 60 of FIG. 3A. In other examples, however, the technique of FIG. 6 may be used to form articles other than blade shroud segment 60 of FIG. 3A, such as, for example, blade shroud segment 24 of FIG. 2A. In yet other examples, additional or alternative techniques may be used to form the tapered abradable coating layers as described herein.

The technique of FIG. 6 may include obtaining substrate 62 with a desired geometry (130). For example, in some cases, a substrate 62 with a substantially curvilinear surface from leading edge 64 to trailing edge 66 may be obtained. In other examples, other surface shapes such as planar, conical, a portion of a conical shape, or the like may be obtained. In yet other cases, a substrate including one or more inclined portions (e.g., first and/or second inclined portions 38*a*, 38*b* as in the example of FIG. 2A) may be obtained. In some examples, obtaining substrate 62 with a desired geometry may include manufacturing substrate 62 with the desired geometry. For example, substrate 62 may manufactured to define a substantially curvilinear surface from leading edge 64 to trailing edge 66. Similarly, a substrate may be manufactured to form one or more inclined portions. In some such examples, the substrate may be manufactured to the desired end-shape. In other examples, the substrate may be machined to form the one or more inclined portions in the substrate.

In some examples, the technique of FIG. 6 optionally includes applying intermediate coating 48 on substrate 62 (132). In some examples, applying intermediate coating 48 on substrate 62 includes applying at least one of a bond coat, an EBC layer, a TBC layer, or a CMAS-resistant layer on substrate 62. Intermediate coating 48 may be applied on substrate 62 using any suitable technique. For instance, intermediate coating 48 may be applied on substrate 62 via thermal spraying, e.g., air plasma spraying, HVOF spraying, low vapor plasma spraying, suspension plasma spraying; PVD, e.g., EB-PVD, DVD, or cathodic arc deposition; CVD; slurry process deposition; sol-gel process deposition; electrophoretic deposition; or the like. In other examples, intermediate coating 48 may be applied on substrate 62 using an additional or alternative technique.

The technique of FIG. 6 further includes applying tapered abradable coating layer 70 on substrate 62 (134). Similar to intermediate coating 48, tapered abradable coating layer 70 may be applied on substrate 62 using any suitable technique, such as, for example, thermal spraying, e.g., air plasma spraying, HVOF spraying, low vapor plasma spraying, suspension plasma spraying; PVD, e.g., EB-PVD, DVD, or cathodic arc deposition; CVD; slurry process deposition; sol-gel process deposition; electrophoretic deposition; or the like. In some examples, the geometry of substrate 62, a target thickness of blade rub portion 76, a minimum thickness of first tapered portion 72 and/or second tapered portion 74, third and/or fourth taper angles $\beta_3$, $\beta_4$, or the like may be considered to apply tapered abradable coating layer 70 on substrate 62. For example, a thermal spray technique (e.g., a number of coating passes, a velocity of a coating device, or the like) may be defined based on one or more of the geometry of substrate 62, a target thickness of blade rub portion 76, a minimum thickness of first tapered portion 72 and/or second tapered portion 74, or third and/or fourth taper angles $\beta_3$, $\beta_4$.

Figure 7:
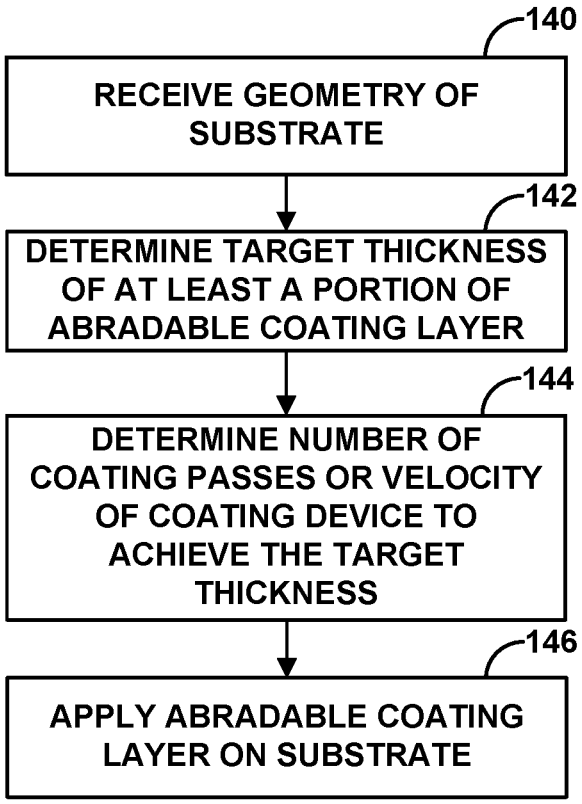
FIG. 7 is a flow diagram illustrating an example technique of applying a tapered abradable layer on a substrate.

FIG. 7 is a flow diagram illustrating an example technique of applying a tapered abradable layer on a substrate. The technique of FIG. 7 will be described with respect to blade shroud segment 60 of FIG. 3A. In other examples, however, the technique of FIG. 7 may be used to form articles other than blade shroud segment 60 of FIG. 3A, such as, for example, blade shroud segment 24 of FIG. 2A. In yet other examples, additional or alternative techniques may be used to form the tapered abradable coating layers as described herein.

The technique illustrated in FIG. 7 includes receiving, by a computing device, a geometry of substrate 62 (140). In some examples, the computing device may include a desktop computer, a laptop computer, a tablet computer, a workstation, a server, a mainframe, a cloud computing system, a robot controller, or the like. The computing device may be configured to control operation of a coating system, including, for example, a stage and a mount for securing an article to be coated, a measuring device to measure a surface geometry of the article, and/or a coating device for applying a coating. The computing device may be communicatively coupled to the stage, the mount, the measuring device, and/or the coating device using respective wired and/or wireless communication connections, e.g., a network link, such as Ethernet or other network connections, USB, IEEE 1394, or the like.

In some examples, the geometry of substrate 62 may include a substantially curvilinear surface from leading edge 64 to trailing edge 66. In other examples, the geometry of substrate 62 may include one or more inclined portions (e.g., as illustrated in FIGS. 2A and 2B). In some examples, receiving the geometry of substrate 62 may include determining, by a computing device, data representative of a three-dimensional surface geometry (e.g., geometry) of substrate 62 from a measuring device. The measuring device may include, for example, a coordinate measuring machine ("CMM") including a CMM probe that may be mechanical, optical, laser, or the like, a structured-light three-dimensional scanner, another non-contacting optical measurement device, digital image correlation, photogrammetry, or the like. In this way, the geometry may include three-dimensional coordinates of a plurality of locations of a surface (e.g., substantially curvilinear surface 68) of substrate 62.

After receiving the data representative of the geometry of the substrate 62, the technique of FIG. 7 includes determining, by the computing device, a target thickness of at least a portion of tapered abradable coating layer 70 to be applied on substrate 62 (142). For example, the computing device may determine one or more of a target thickness of blade rub portion 76, a minimum thickness of first tapered portion 72, or a minimum thickness of second tapered portion 74. As described above, the target thickness of blade rub portion 76 may include a thickness so that blade tip 52 does not contact or abrade intermediate coating 48 and/or substrate 62 during rotation of blade 26.

After determining the target thickness of at least a portion of tapered abradable coating layer 70, the technique of FIG. 7 includes determining, by the computing device, a number of passes of a coating device, a velocity that the coating device will travel over the surface of substrate 62, or both to achieve the target thickness (144).

In some examples, the number of passes and/or velocity may be based on a predetermined template coating program. In some examples, the predetermined template program may define parameters for a coating process and may be experimentally verified. In some examples, each of these parameters may be fixed, and only the number of passes and/or the velocity of the coating device relative to substrate 62 may be changed by the computing device. In some such examples, the predetermined template program may include a plurality of subroutines, and the computing device may determine a respective number of passes of a coating device for each location of the surface of substrate 62 (e.g., a respective number of times each respective subroutine of a predetermined template program is to be executed or performed). As one example, the number of coating passes may be determined by dividing a width of first tapered portion 72 or second tapered portion 74 by 5, and then dividing 40 by that number. For example, if first tapered portion 72 has a width of 25 mm, 8 coating passes may be used to achieve the target thickness of the abradable coating layer 70 (e.g., 25/5=5; 40/5=8 coating passes).

Additionally, or alternatively, the computing device may determine a velocity of the coating device relative to substrate 62 for each respective location of the surface of substrate 62 (e.g., a respective velocity for each respective subroutine of the coating device). In this way, in some examples, the technique of FIG. 7 may include determining, by the computing device, a number of passes of the coating device with respect to each location of the surface of substrate 62, a velocity of the coating device with respect to each location of the surface of substrate 62, or both, in order to determine a coating program for applying tapered abradable coating layer 70 to achieve the target thickness of at least the portion, such as blade rub portion 76.

In some examples, a coating program to apply tapered abradable coating layer 70 including first tapered portion 72, second tapered portion 74, and blade rub portion 76 may include a technique in which each width of a subsequent coating pass of a plurality of coating passes may be reduced during application of the coating until the target thickness is achieved (e.g., a coating pass reduction technique). For example, a width of substrate 62 (e.g., from leading edge 62 to trailing edge 64) may be determined. In some examples, the width of substrate 62 may be determined when the geometry of substrate 62 is determined. In other examples, the width of substrate 62 may be determined at a different time.

Then, based on the target thickness of tapered abradable coating layer 70 (e.g., of blade rub portion 76) and the number of coating passes and/or velocity of the coating device, a coating pass reduction width may be selected. In some cases, additional parameters may be used to select the coating pass reduction width. For example, a width of blade rub portion 76, first tapered portion 72, and/or second tapered portion 74, a minimum thickness of first and/or second tapered portion 72, 74, or the like may be used to select the coating pass reduction width. In some examples, the coating pass reduction width may be about 5 mm. In some cases, the coating pass reduction width may be a different width. For instance, the coating pass reduction width may be determined based on the length of first tapered portion 72 and/or second tapered portion 74.

In this way, the coating program may include applying a first coating pass of tapered abradable coating layer 70 from an initial position on substrate 62 to a terminal position on substrate 62. For instance, the initial position may include leading edge 64 and the terminal position may include trailing edge 66. A second coating pass may be applied on substrate 62 from a subsequent initial position on substrate 62 to a subsequent terminal position on substrate 62. The subsequent initial position may be a distance of the coating pass reduction width from the previous initial position (e.g., the initial position) in a direction toward the terminal position. In a similar manner, the subsequent terminal position may be a distance of the coating pass reduction width from the previous terminal position (e.g., the terminal position) in a direction toward the initial position. Additional coating passes may be applied on substrate 62 in a similar manner until the target thickness of the portion of tapered abradable coating layer 70 is achieved. For example, each subsequent initial position of each coating pass may be about the coating pass reduction width closer to the terminal position in comparison to a previous initial position of a previous coating pass. Similarly, each subsequent terminal position of each coating pass may be about the coating pass reduction width closer to the initial position in comparison to a previous terminal position of a previous coating pass. In some examples, one or more additional coating passes may be applied on substrate 62 once the target thickness has been achieved. For example, a plurality of coating passes having a width of blade rub portion 76 may be applied on substrate 62 such that blade rub portion 76 defines a substantially constant thickness portion of tapered abradable coating layer 70.

In some examples, only one of the subsequent initial positions or subsequent terminal positions may be adjusted by the coating pass reduction width. For example, in examples in which tapered abradable coating layer 70 only includes one tapered portion (e.g., tapered abradable coating layer 102 of FIGS. 4A and 4B), only one tapered portion may need to be formed using a coating program including a coating pass reduction technique.

Moreover, in some cases, each subsequent coating pass may not be adjusted by the coating pass width. For example, in some cases, the coating pass width may be adjusted by the coating pass reduction width every 3, 5, 8, 10, or 20 coating passes. Additionally, or alternatively, the coating program may not adjust the coating pass width at the same interval, by the same coating pass reduction width, or the like over the entire coating program (e.g., over a plurality of coating passes to form tapered abradable coating layer 70).

The technique of FIG. 7 further includes applying tapered abradable coating layer 70 on substrate 62 (146). For example, applying tapered abradable coating layer 70 on substrate 62 may include controlling the coating device to apply tapered abradable coating layer 70 on substrate using the determined number of passes and/or velocity of the coating device to achieve the target thickness. As another example, tapered abradable coating layer 70 may be applied on substrate 62 using a coating program, such as, for example, a coating program including the coating pass reduction technique as described herein. In some examples, applying tapered abradable coating layer 70 on substrate 62 may require less coating material from which tapered abradable coating layer 70 is formed, reduce sensitivity to edge discontinuities in the applied coating, reduce stress on blade shroud segment 60, reduce overspray of the coating material (e.g., coating material that is wasted), or the like.

As yet another example, in some cases, tapered abradable coating layer 70 may be applied on substrate 62 having a thickness greater than or equal to the target thickness from leading edge 64 to trailing edge 66 (e.g., in a relatively constant thickness) and then the applied coating may be machined to define at least one tapered portion (e.g., first tapered portion 72 and/or second tapered portion 74). In some examples, applying tapered abradable coating layer 70 without machining the layer (or without substantially machining the layer) may be less expensive, waste less coating material from which tapered abradable coating layer 70 is formed, and/or leave less residual stress in tapered abradable coating layer 70 60.

Various examples have been described. These and other examples are within the scope of the following claims.

What is claimed is:

1. A system comprising:

a gas turbine engine comprising:

a blade comprising a blade tip; and a blade track or blade shroud segment comprising a substrate comprising a ceramic matrix composite and a coating comprising an environmental barrier coating layer on the substrate and an abradable coating layer on the environmental barrier coating layer, wherein the environmental barrier coating comprises at least one of a rare earth silicate, a rare earth oxide, an aluminosilicate, or an alkaline earth aluminosilicate, wherein the substrate defines a leading edge, a trailing edge, an intersegment edge adjacent to another blade track or blade shroud segment, and an opposing edge opposite the intersegment edge, wherein an axial axis extends between the leading edge and the trailing edge in an axial direction of the gas turbine engine, wherein a circumferential axis extends between the intersegment edge and the opposing edge in a circumferential direction of the gas turbine engine; and wherein the abradable coating layer comprises:

a first tapered portion that substantially continuously tapers in a direction perpendicular to the leading edge or the trailing edge from a center portion of the substrate toward the leading edge of the substrate;

a second tapered portion that substantially continuously tapers in a direction perpendicular to the leading edge or the trailing edge from the center portion of the substrate toward the trailing edge of the substrate;

a third tapered portion that substantially continuously tapers from the center portion to the intersegment edge, wherein the abradable coating layer does not taper from the center portion to the opposing edge; and a blade rub portion that extends between the first tapered portion, the second tapered portion, and the third tapered portion to the opposing edge, wherein the blade tip is configured to contact the third tapered portion prior to engaging the blade rub portion upon rotation of the blade, and wherein the abradable coating layer extends from the leading edge to the trailing edge.

2. The system of claim 1, wherein the substrate defines a curvilinear surface from the leading edge to the trailing edge.

3. The system of claim 1, wherein the substrate defines a first inclined portion from the center portion to the leading edge and a second inclined portion from the center portion to the trailing edge.

4. The system of claim 3, wherein the first inclined portion and the second inclined portion of the substrate are each inclined relative to the center portion at an angle between about 1° and about 30°.

5. The system of claim 1, wherein the blade rub portion of the abradable coating layer has a thickness of between about 0.25 mm and about 3 mm, the first tapered portion has a minimum thickness of greater than 0 mm, and the second tapered portion has a minimum thickness of greater than 0 mm.

6. The system of claim 1, wherein the blade rub portion defines a first width measured along an axial axis extending from the leading edge to the trailing edge of the substrate, and the blade tip defines a second width measured along the axial axis, wherein the first width is greater than the second width.

7. The system of claim 1, wherein the blade track or blade shroud segment further comprises at least one of a bond coat or a thermal barrier coating (TBC) layer on the substrate, and wherein the abradable coating layer is on the EBC layer or TBC layer.

8. A system comprising:

a blade comprising a blade tip; and a blade track or blade shroud segment comprising a substrate and an abradable coating layer on the substrate, wherein the substrate defines:

an intersegment edge, wherein the intersegment edge is adjacent to another blade track or blade shroud segment of a gas turbine engine, and an opposing edge opposite the intersegment edge, and a circumferential axis extending between the intersegment edge and the opposing edge and in a circumferential direction, wherein the abradable coating layer defines:

a tapered portion that substantially continuously tapers along the circumferential axis from a center portion of the substrate to the intersegment edge, and a non-tapered portion that extends from the tapered portion to the opposing edge of the substrate and is not tapered along the circumferential axis from the center portion to the opposing edge, wherein the blade tip is configured to engage the tapered portion prior to engaging the non-tapered portion upon rotation of the blade in a circumferential direction.

9. The system of claim 8, wherein the substrate defines a substantially curvilinear surface from the intersegment edge to the opposing edge.

10. The system of claim 8, wherein the system comprises the gas turbine engine, wherein the circumferential axis is in a circumferential direction of the gas turbine engine, and wherein the substrate further defines a leading edge and a trailing edge, wherein an axial axis extends between the leading edge and the trailing edge and is in a axial direction, and wherein a first width of the tapered portion as measured along the axial axis is less than a second width of the substrate from the leading edge to the trailing edge.

11. The system of claim 8, wherein the non-tapered portion of the abradable coating layer has a thickness of between about 0.25 mm and about 3 mm, and the tapered portion has a minimum thickness of greater than 0 mm.

12. The system of claim 11, wherein the tapered portion has a minimum thickness of at least about 0.075 mm.

13. The system of claim 8, wherein the system comprises a gas turbine engine, wherein the circumferential axis is in a circumferential direction of the gas turbine engine, and the tapered portion comprises a first tapered portion, and wherein the substrate further defines:

a leading edge and a trailing edge, wherein:

an axial axis extends between the leading edge and the trailing edge and is in a axial direction, the center portion extends between the intersegment edge and the opposing edge, and between the leading edge and the trailing edge, the abradable coating layer further defines:

a second tapered portion that substantially continuously tapers in a direction perpendicular to the leading edge or the trailing edge from the center portion of the substrate toward the leading edge of the substrate, and a third tapered portion that substantially continuously tapers in a direction perpendicular to the leading edge or the trailing edge from the center portion of the substrate toward the trailing edge of the substrate, and the non-tapered portion extends between the first tapered portion, the second tapered portion, and the third tapered portion.

14. The system of claim 8, wherein the blade track or blade shroud segment further comprises at least one of a bond coat, an environmental barrier coating (EBC) layer, or a thermal barrier coating (TBC) layer on the substrate, and wherein the abradable coating layer is on the at least one bond coat, EBC layer, or TBC layer.

* * * * *